US008991933B2

(12) United States Patent
Johansson

(10) Patent No.: US 8,991,933 B2
(45) Date of Patent: Mar. 31, 2015

(54) BACKREST FOR WHEELCHAIR

(75) Inventor: Ulf Johansson, Älmhult (SE)

(73) Assignee: Invacare International Sarl, Gland (CH)

( * ) Notice: Subject to any disclaimer, the term of this patent is extended or adjusted under 35 U.S.C. 154(b) by 4 days.

(21) Appl. No.: 13/598,136

(22) Filed: Aug. 29, 2012

(65) Prior Publication Data

US 2013/0106159 A1 May 2, 2013

(30) Foreign Application Priority Data

Aug. 29, 2011 (EP) ..... 11179221

(51) Int. Cl.

| | |
|---|---|
| ***A47C 7/14*** | (2006.01) |
| ***A47C 7/46*** | (2006.01) |
| ***A61G 5/10*** | (2006.01) |
| *A61G 5/12* | (2006.01) |

(52) U.S. Cl.

CPC ..... *A61G 5/1062* (2013.01); *A61G 2005/1091* (2013.01); *A61G 2005/122* (2013.01)

USPC ..... 297/452.4; 297/284.8; 297/284.9; 297/350; 297/452.33; 297/452.34; 297/452.63

(58) Field of Classification Search

USPC ..... 297/233, 284.8, 284.9, 350, 351, 297/452.33, 452.34, 452.63, 452.4

See application file for complete search history.

(56) References Cited

U.S. PATENT DOCUMENTS

| | | | | | |
|---|---|---|---|---|---|
| 371,091 | A | * | 10/1887 | Miller | 297/351 X |
| 455,933 | A | * | 7/1891 | Timmons | 297/233 |
| 966,891 | A | * | 8/1910 | Dudley | 297/350 X |
| 1,318,569 | A | * | 10/1919 | Kramer | 5/12.1 |
| 2,534,009 | A | | 12/1950 | Freasier et al. | |
| 3,743,351 | A | * | 7/1973 | Harris | 297/233 X |
| 3,759,572 | A | * | 9/1973 | Koepke | 297/351 X |
| 5,564,786 | A | | 10/1996 | Peek et al. | |
| 5,660,436 | A | * | 8/1997 | Wilson | 297/233 |
| 5,681,084 | A | * | 10/1997 | Yoneda | 297/284.9 |

(Continued)

FOREIGN PATENT DOCUMENTS

| | | |
|---|---|---|
| EP | 11179221.4 | 8/2011 |
| WO | 97/17929 | 5/1997 |

OTHER PUBLICATIONS

International Search Report for EP Application No. 11179221 dated Jan. 11, 2012.

*Primary Examiner* — Rodney B White

(74) *Attorney, Agent, or Firm* — Calfee, Halter & Griswold LLP; Mark R. Hull

(57) ABSTRACT

A backrest includes first and second side wings and connectors configured to connect the first and second side wings to the wheelchair frame. The first side wing comprises a plurality of transverse profiles extending towards the second side wing and the second side wing comprises a plurality of second transverse profiles extending towards the first side wing. At least one first transverse profile of the first side wing and at least one associated second transverse profile of the second side wing are at least partially mutually embraced in a slidable manner. The at least one first transverse profile and the at least one second transverse profile are dimensioned and configured so that the mutual slidably embracement of the at least one first transverse profile and the at least one second transverse profile is made on a range of distances enabling the width adjustment of the backrest.

18 Claims, 9 Drawing Sheets

(56) References Cited

U.S. PATENT DOCUMENTS

| | | | | | |
|---|---|---|---|---|---|
| 5,848,824 | A | * | 12/1998 | Mocur | 297/440.2 |
| 5,906,416 | A | | 5/1999 | Rasmussen | |
| 5,944,385 | A | * | 8/1999 | Pearce | 297/284.9 X |
| 5,954,402 | A | | 9/1999 | McInturff | |
| 5,984,418 | A | * | 11/1999 | McInturff | 297/440.24 |
| 6,135,545 | A | * | 10/2000 | Liao | 297/233 X |
| 6,257,664 | B1 | * | 7/2001 | Chew et al. | 297/284.9 |
| 6,352,307 | B1 | * | 3/2002 | Engman | 297/284.1 X |
| 6,460,933 | B1 | * | 10/2002 | Bors et al. | 297/284.9 X |
| 6,688,693 | B2 | * | 2/2004 | Christofferson et al. | 297/354.12 |
| 6,913,318 | B2 | * | 7/2005 | Higley et al. | 297/383 |
| 8,070,232 | B2 | * | 12/2011 | Hung | 297/383 |
| 8,186,756 | B2 | * | 5/2012 | Jorgensen | 297/284.9 X |
| 2003/0030318 | A1 | * | 2/2003 | Christofferson et al. | 297/452.34 |

* cited by examiner

BACKREST FOR WHEELCHAIR

RELATED APPLICATIONS

The present application claims the benefit of European Patent Application No. 11179221.4, filed on Aug. 29, 2011, which is incorporated herein by reference in its entirety.

FIELD OF THE INVENTION

The present invention relates to the field of backrests. More particularly, the invention pertains to a width adjustable backrest for wheelchair.

BACKGROUND OF THE INVENTION

There is an increasing need for variable adjustment possibilities in order to adapt the backrest configuration, in particular its width, to the individual requirements of a particular wheelchair user. The requirements can occur from the need of comfort of the user or from the need of accommodation of a variety of health issues and reasons for wheelchair use.

Document U.S. Pat. No. 2,534,009 describes a conventional adjustable backrest, which comprises a pair of spaced apart side bars, each side bar having a plurality of spaced transverse bars extending therefrom towards the opposite side bar. The transverse bars of the two side bars comprise each a circular through hole and a slot. Fasteners pass through corresponding hole and slot in order to fasten the transverse bars together, the holes and slots being positioned so that the lateral spacing of the side bars is adjustable. According to this embodiment, the width adjustment of the backrest depends on the lengths of the slots, nevertheless the side bars do not contribute itself to the width adjustment and therefore limit the width adjustment. Moreover, the transverse bars of each side bar are not linked together so that the reliability of the assembly depends essentially on the connection means between the side bars and their transverse bars.

Document U.S. Pat. No. 5,564,786 describes an adjustable seat frame. The frame comprises a pair of spaced apart side rail having a plurality of spaced parallel transverse beams extending therefrom towards the opposite rail and a central beam telescopingly engaged between corresponding beams on each rail. Here again, the side rails do not contribute to the width adjustment of the frame and the transverse beams are not linked together. Due to the connections between each central beam and its corresponding transverse beams, this embodiment need two times more fastening means than the embodiment described in U.S. Pat. No. 2,534,009.

SUMMARY OF THE INVENTION

In line with the invention, it is proposed a backrest intended to be connected to a wheelchair frame comprising a first lateral end, a second lateral end, a front side and a back side, at least one pair of side wings, namely a first side wing and a second side wing, that may be generally vertically oriented when connected to the wheelchair frame, and connectors configured to fixedly connect the first side wing and the second side wing to the wheelchair frame, wherein the first side wing comprises a plurality of vertically spaced first transverse profiles extending therefrom towards the second side wing and the second side wing comprises a plurality of vertically spaced second transverse profiles extending therefrom towards the first side wing and wherein at least one first transverse profile of the first side wing and at least one associated second transverse profile of the second side wing are at least partially mutually embraced in a slidable manner, the at least one first transverse profile and the at least one second transverse profile being dimensioned and configured so that the mutual slidably embracement of the at least one first transverse profile and the at least one second transverse profile is made on a range of distances enabling the width adjustment of the backrest, the mutual embracement of the at least one first transverse profile and the at least one second transverse profile being configured to prevent the side wings from disengaging from each other in a direction other than the slidably direction of the side wings and the first transverse profiles, respectively the second transverse profiles, being at least partially linked together so as to define approximately a continuous surface $S_c$.

The invention also concerns a wheelchair having a backrest as defined above.

The backrest is adjustable in width and can be connected to a large variety of wheelchair frames. The width adjustable backrest is sustainable and reliable. The connectors are configured to fixedly connect the first side wing and the second side wing to the wheelchair frame. The mutual embracement of the first and second transverse profiles, as well as optionally the hollow buckles and the openings, are configured to prevent the side wings from disengaging from each other in a direction other than the sildably direction of the side wings, in particular to prevent the side wings from disengaging from each other in a direction perpendicular to the transverse profiles. Apart from the connectors, which connect the side wings to the wheelchair frame, additional fasteners fastening the side wings together are unnecessary since the connection of the side wings to the wheelchair frame determines the relative positioning of the side wings in relation to one another and since the mutual embracement of the first and second transverse profiles prevent the disengagement of the side wings. The numbers of connectors and fasteners are therefore minimized. The arrangement for adjusting the width of the backrest are therefore simple and trouble-free and require the use of common and unitary tool. Advantageously, the width adjustment of the backrest is maximized since the entire widths of the side wings contribute to the width adjustment. Moreover, the first transverse profiles, respectively the second traverse profiles, are at least partially linked together so as to define approximately a continuous surface. Therefore, the resultant force applied by the wheelchair user in the backrest is distributed over the backrest surface. The sustainability and the reliability of the backrest are thus strengthened. Advantageously, the side wings are sandwiched between plates, which are connected together with the help of a first fastener. A second fastener is used to firmly fasten the side wings and the plates together in a position of use in which the width of the backrest cannot be changed. This sandwich assembly strengthens the stiffness of the backrest. The first fastener and the second fastener are advantageously positioned on the vertical symmetry axis of the backrest. According to a resultant force applied by a wheelchair user in the symmetry axis of the backrest, no bending stress is applied to the fasteners positioned on the said symmetry axis. There is therefore no risk of accidental undoing or breaking of the fasteners.

Further objects, features and advantages of the invention will become apparent to a person skilled in the art upon reading the specification and appended drawings.

BRIEF DESCRIPTION OF THE DRAWINGS

The invention will be better understood with the aid of the description of an embodiment given by way of example and illustrated by the figures, in which.

DETAILED DESCRIPTION OF THE INVENTION

The present invention will now be described more fully hereinafter with reference to the appended FIGS. 1 to 7, in which one embodiment of the invention is shown. The invention may, however, be embodied in many different forms and should not be construed as limited to the embodiments set forth herein; rather, these embodiments are provided so that this disclosure will be thorough and complete, and will fully convey the scope of the invention to the person skilled in the art.

Varying a backrest width of a wheelchair permits the backrest to suit different users having different body constitutions and varying handicaps. This degree of adjustment also enables the backrest to accommodate a patient's growth easily. Furthermore, whereas a width adjustable backrest can be connected to a large variety of wheelchair frames, the industrial production of backrests is rationalized. Indeed, the width of the backrest is adjusted at the time of mounting according to the width of the frame. Avoiding the production of backrest of different sizes, the production costs are reduced. Moreover, the supply of such width adjustable backrests reduces the stocks of retailers or specialized institutions and simplifies the management of the said stocks.

The design and the proportioning of an adjustable backrest have to provide high degrees of sustainability and reliability. In all situations, the adjustable backrest has to meet the safety needs of the wheelchair user. Moreover, the means for adjusting the width of the backrest should advantageously be uncomplicated and trouble-free and require the use of common and unitary tool to accomplish the width adjustment. The numbers of connectors and fasteners should be minimized. Moreover, in order to maximize the width adjustment of the backrest, the entire widths of the backrest should contribute to the width adjustment.

Therefore, there is a need for a backrest for wheelchair fulfilling, respectively avoiding, the above-mentioned requirements and drawbacks. The aim of the present invention is thus to provide a solution to these problems.

Figure 1:
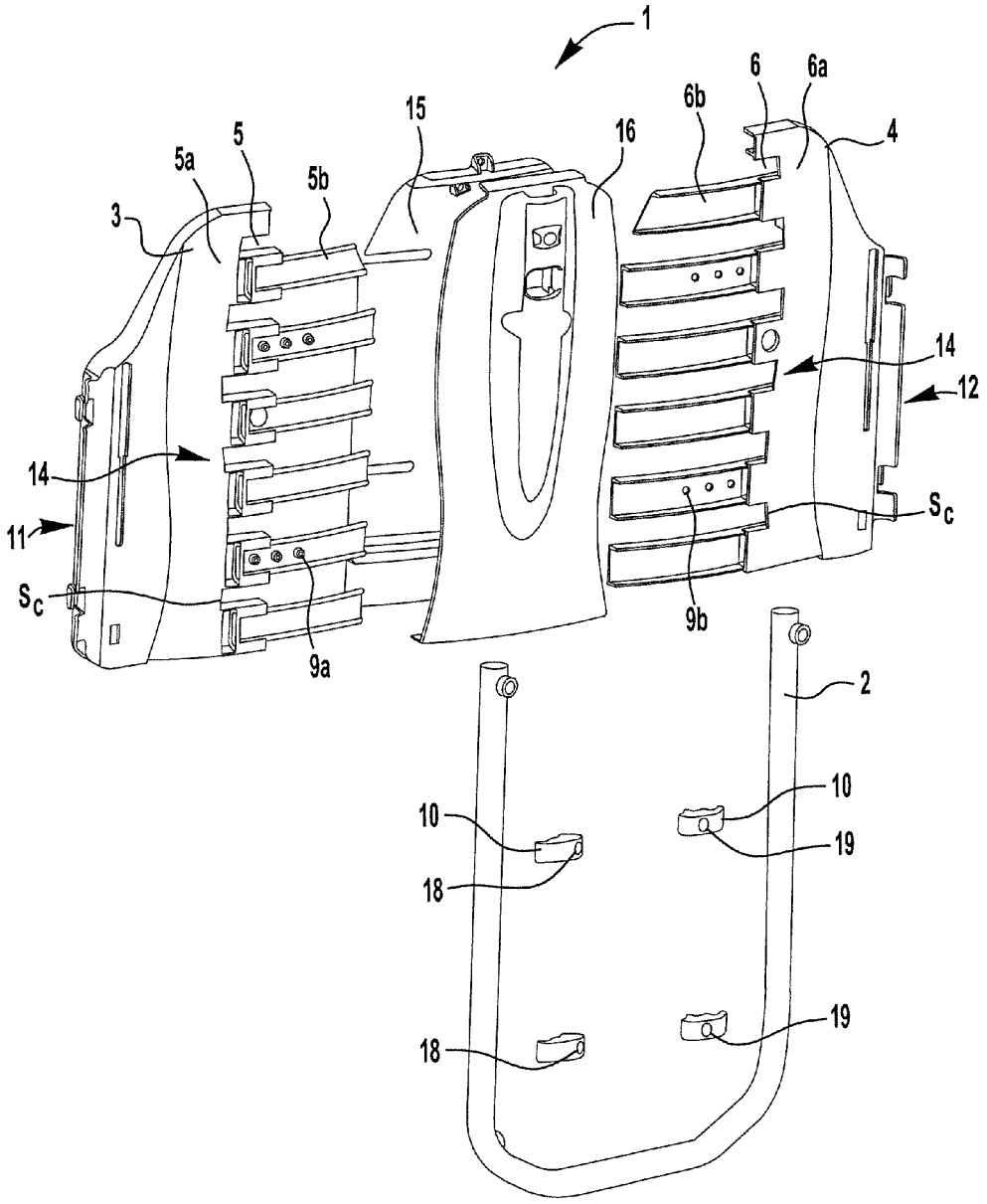
FIG. 1 depicts an exploded back perspective view of a backrest in accordance with the invention.
Figure 2:
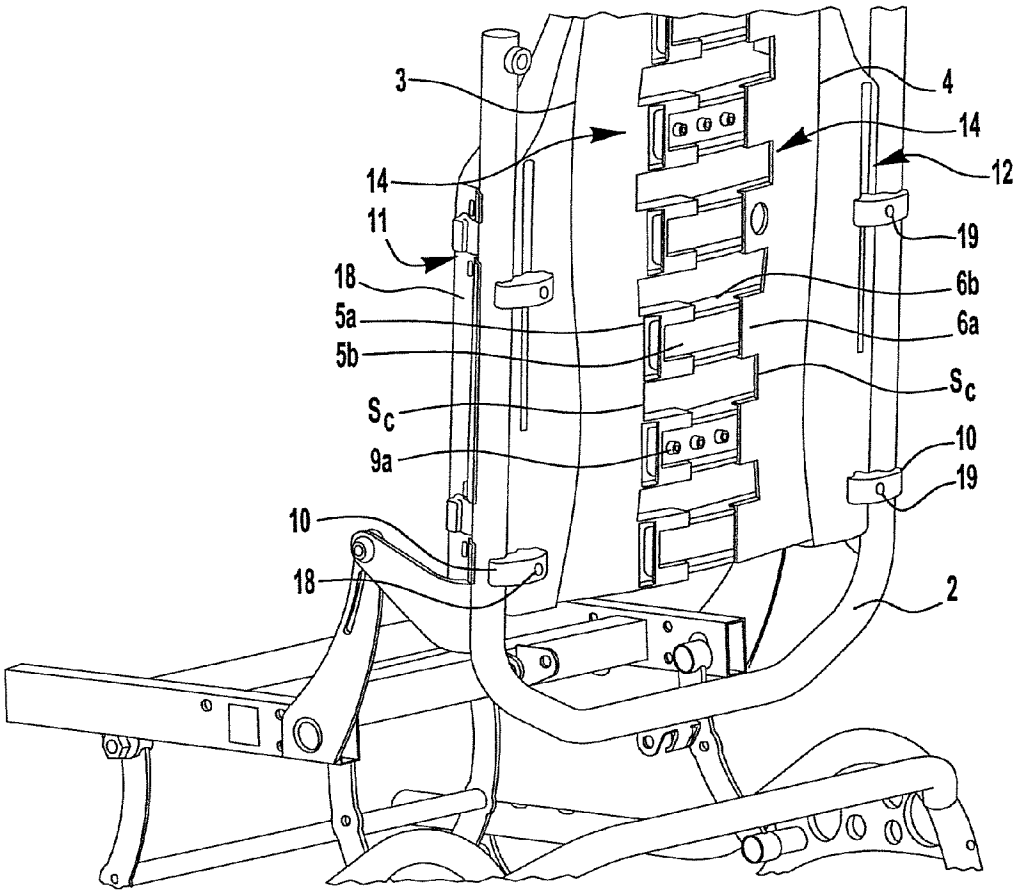
FIG. 2 depicts a back perspective view of a backrest in accordance with the invention connected to a wheelchair frame.

FIG. 1 depicts an exploded back perspective view of a backrest 1 in accordance with the invention. The backrest 1 comprises a first lateral end 11, a second lateral end 12, a front side 13 and a back side 14, as well as one pair of side wings, namely a first side wing 3 and a second side wing 4, and connector 10 configured to fixedly connect the first side wing 3 and the second side wing 4 to the wheelchair frame 2. Optionally, the backrest 1 comprises one pair of plates, namely a first plate 15 and a second plate 16, disposed on each side of the backrest 1, respectively in the front side 13 and in the back side 14 of the backrest 1. The side wings 3 and 4 and the plates 15 and 16 may be generally vertically oriented when connected to a wheelchair frame 2. For instance, one pair of assembled side wings, which are connected to the wheelchair frame 2, is shown in FIG. 2.

The first side wing 3 comprises a plurality of vertically spaced first transverse profiles 5 extending therefrom towards the second side wing 4 and the second side wing 4 comprises a plurality of vertically spaced second transverse profiles 6 extending therefrom towards the first side wing 3. As described in detail hereinafter, the mutual embracement of the first and second transverse profiles 5 and 6 are configured to allow the backrest 1 to be adjustable in width in a slidable manner. Moreover, the mutual embracement of the first and second transverse profiles 5 and 6 are configured to prevent the side wings 3 and 4 from disengaging from each other in a direction other than the slidably direction of the side wings, in particular to prevent the side wings from disengaging from each other in a direction perpendicular to the transverse profiles 5 and 6. The mutual embracement of the first and second transverse profiles 5 and 6 should be understood in the way that some portions of the first transverse profiles 5 are configured to embrace some portions of the second transverse profiles 6 and some other portions of the first transverse profiles 5 are configured to be embraced by some other portions of the second transverse profiles 6. As a definition, "to embrace at least partially" should be understood as to enclose, to surround or to envelop at least partially. Specifically, "at least partially" should be understood in the sense that an embracing element does not necessarily enclose, surround or envelop entirely the cross section of the associated embraced element.

The first transverse profiles 5 of the first side wing 3 comprise each a first embracing portion 5*a* and a first embraced portion 5*b*, the first embracing portion 5*a* being closer to the first lateral end 11 of the backrest 1 than the first embraced portion 5*b*. Respectively, the second transverse profiles 6 of the second side wing 4 comprise each a second embracing portion 6*a* and a second embraced portion 6*b*, the second embracing portion 6*a* being closer to the second lateral end 12 of the backrest 1 than the second embraced portion 6*b*. The first embracing portions 5*a* of the first side wing 3 and the second embracing portions 6*a* of the second side wing 4 are configured to slidably at least partially embrace respectively the second embraced portions 6*b* of the second side wing 4 and the first embraced portions 5*b* of the first side wing 3, the first embracing portions 5*a*, the second embracing portions 6*a*, the first embraced portions 5*b* and the second embraced portions 6*b* being dimensioned and configured so that the slidably embracement of the side wings 3 and 4 is made on a range of distances enabling the width adjustment of the backrest. The connector 10 comprises at least one first clamp 18 disposed at the first lateral end 11 of the backrest 1 and at least one second clamp 19 disposed at the second lateral end of the backrest 1, the at least one first clamp 18 and the at least one second clamp 19 being adapted for engaging the wheelchair frame 2 in order to connect receptively the first side wing 3 and the second side wing 4 to the wheelchair frame 2. The at least one first clamp 18 and the at least one second clamp 19 are respectively fixed to the first side wing 3 and to the second side wing 4 with the help of nuts and bolts. Apart from the connectors 10, which connect the side wings 3 and 4 to the wheelchair frame 2, additional fasteners fastening the side wings together are unnecessary since the connection of the side wings to the wheelchair frame determines the relative positioning of the side wings in relation to one another and since the mutual embracement of the first and second transverse profiles prevent the disengagement of the side wings. Moreover, the first transverse profiles 5, respectively the second transverse profiles 6, are made in one single piece so as to define a continuous surface $S_c$ offering strengthened sustainability and reliability of the backrest. In particular, the first embracing portions 5*a* of the first side wing 3, respectively the second embracing portions 6*a* of the second side wing 4, are linked together so as to define approximately a continuous surface $S_c$ offering strengthened sustainability and reliability of the backrest. Indeed, by virtue of the continuous surfaces $S_c$, the resultant force applied by a wheelchair user in the backrest is distributed over the backrest surface. The risk of accidental breaking of the transverse profiles 5 and 6 is therefore reduced. Moreover, the width adjustment of the backrest is maximized since the entire widths of the side wings contribute to the backrest width adjustment.

As mentioned above, the backrest optionally comprises one pair of plates, namely a first plate 15 and a second plate 16, disposed on each side of the backrest 1, respectively in the front side 13 and in the back side 14 of the backrest 1. Indeed, the first side wing 3 and the second side wing 4 can advantageously be sandwiched between the first plate 15 and the second plate 16, the first plate 15 and the second plate 16 being connected together with the help of first fastener 17 (see FIGS. 7A and 7B) and at least one of the plates being connected to the side wings with the help of a second fastener 57. By virtue of the first plate 15 and the second plate 16 sandwiching the side wings 3 and 4, the stiffness of the backrest 1 is strengthened. The sustainability and the reliability of the backrest 1 are therefore increased. Moreover, the first plate 15 and the second plate 16 protect the side wings 3 and 4 from dust and dirt, which could potentially affect the slidably embracement of the side wings 3 and 4. The plates 15 and 16 can advantageously offer fixation points to additional backrest elements (not shown) like cushions and storage units as well as width and height adjustable structures like headrests, additional backrest plates or wings and any rest of body limp. In particular, the first plate 15 comprises a plurality of through holes and the second plate 16 comprises a plurality of associated threaded holes distributed along at least the backrest height. The first fasteners 17 comprise a plurality of nuts, each nut being engaged in each through holes and threaded onto the associated threaded hole in order to fasten the first plate 15 and the second plate 16 together. The plurality of through holes and the plurality of associated threaded holes are respectively positioned on the first plate 15 and on the second plate 15 so that the first fasteners can pass through the space between two adjacent transverse profiles of the first and second side wings 3 and 4. Furthermore, at least some of the plurality of through holes and at least some of the associated threaded holes can advantageously be respectively positioned on the first plate 13 and on the second plate 14 so that the first fasteners 17 are positioned at least partially on the vertical symmetry axis of the backrest. According to a resultant force applied by a wheelchair user in the symmetry axis of the backrest, no bending stress is therefore applied to the first fasteners 17. The sustainability and the reliability of the backrest are thus increased. Moreover, second fasteners 57 are used to firmly fasten the side wings 3 and 4 and the plates 15 and 16 together in a position of use in which the width of the backrest 1 cannot be changed. At least one of the first plate 15 or second plate 16 advantageously comprises at least one third through hole 59. Moreover, as shown in FIG. 1, two first transverse profiles 5 comprise a plurality of first circular through holes 9*a* and the associated two second transverse profiles 6 comprise a plurality of associated second circular through holes 9*b*. The plurality of first circular through holes 9*a* and the plurality of associated second circular through holes 9*b* are positioned on their respective transverse profiles so that at least one of the plurality of the first circular through hole 9*a* and at least one of the plurality of associated second circular though hole 9*b* are placed opposite one another for each desired width configuration of the backrest. The second fasteners 57 may be passed through at least one of the plurality of first circular through holes 9*a*, through at least one of the plurality of the associated second circular though holes 9*b* and though at least one of the at least one third through hole 59 in order to firmly fasten the first side wing 3, the second side wing 4, the first plate 15 and the second plate 16 together, the first plate 15 and the second plate 16 being connected together with the help of the first fasteners. The second fasteners comprise two pairs of nut and bolt. The two nuts are each engaged in one of the plurality of first circular through holes 9*a*, in one of the plurality of the associated second circular through holes 9*b* and in at least one of the at least one third through hole and threaded onto the associated bolt. The plurality of first circular through holes 9*a*, the plurality of second circular through holes 9*b* and the at least one third through hole are advantageously positioned on the first transverse profiles 5, on the second transverse profile 6 and on the first or second plate so that the second fasteners can be positioned on the vertical symmetry axis of the backrest 1 for each desired width configuration. According to a resultant force applied by a wheelchair user in the symmetry axis of the backrest, no bending stress is therefore applied to the second fasteners. There is thus no risk of accidental undoing or breaking of the second fasteners. Moreover, the plurality of first circular through holes 9*a* and the plurality of associated second circular through holes 9*b* are positioned on their respective transverse profiles so that at least one of the plurality of the first circular through hole 9*a* and at least one of the plurality of associated second circular though hole 9*b* are placed opposite one another in the symmetry axis of the backrest for each desired width configuration. Accordingly and with the help of the second fasteners, the first plates 15 and the second plates 16 are centered in the backrest.

Figure 3:
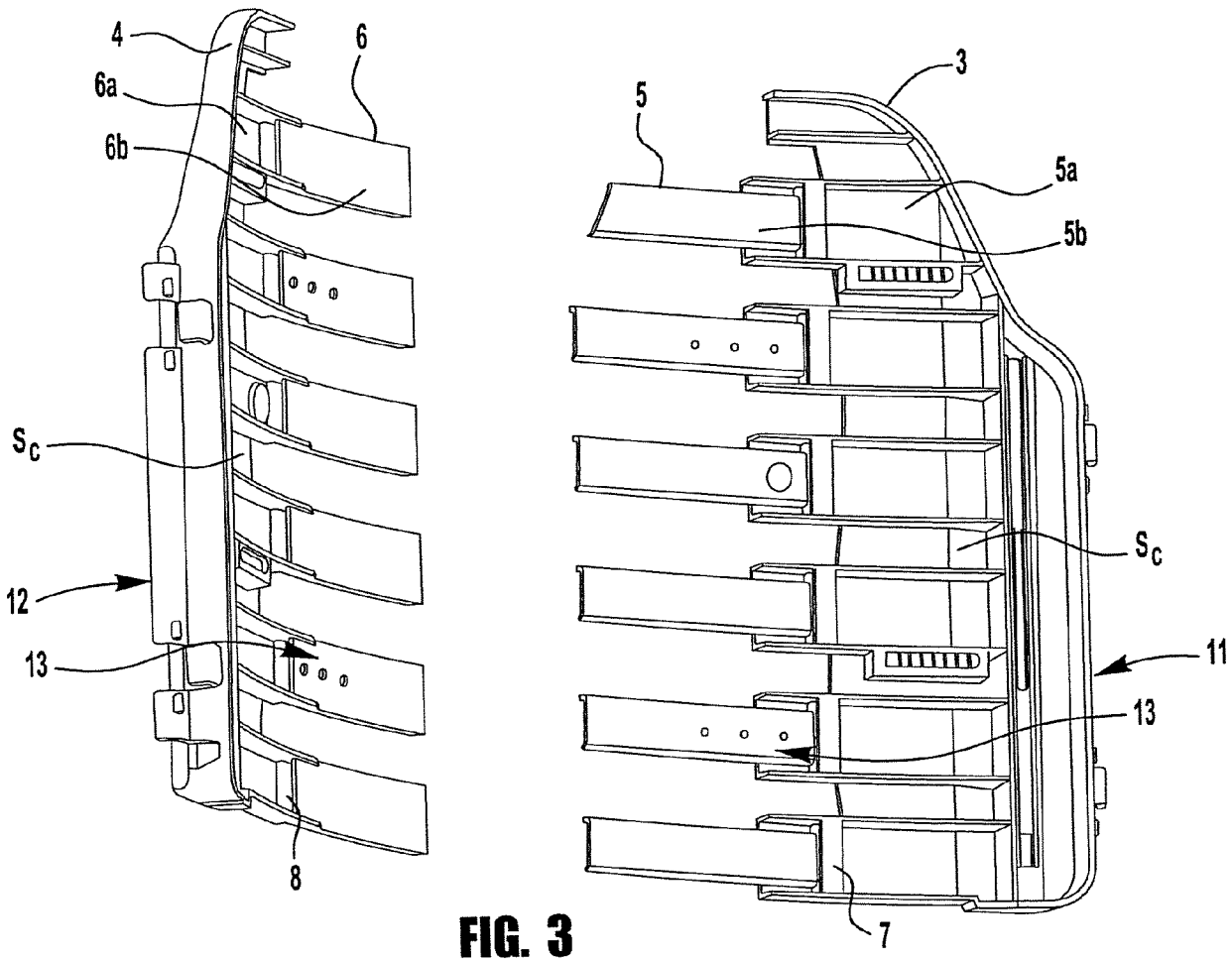
FIG. 3 depicts a front perspective view of one pair of disassembled side wings in accordance with FIG. 1.
Figure 4:
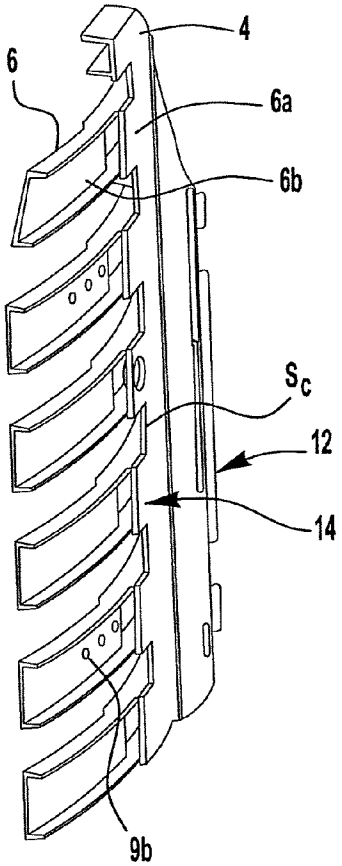
FIG. 4 depicts a back perspective view of one pair of disassembled side wings in accordance with FIG. 1.
Figure 4:
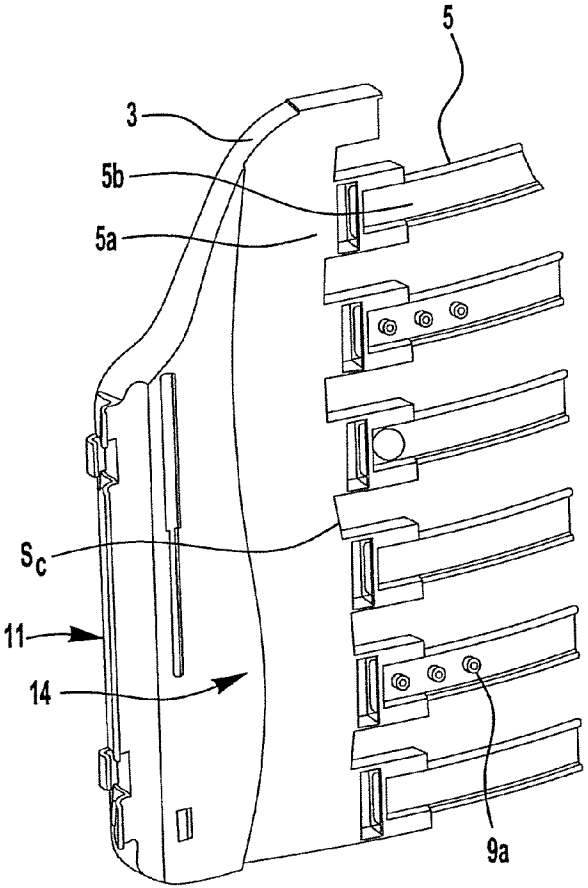

FIG. 3 and FIG. 4 depict respectively a front perspective view and a back perspective view of one pair of disassembled side wings of the backrest 1 in accordance with FIG. 1. In the illustrated embodiment, the first transverse profiles 5 and the second transverse profiles 6 are parallel with each other. Moreover, each first transverse profile 5, in particular each first embracing portion 5*a*, comprises one hollow buckle 7 in which the associated second transverse profile 6, in particular the second embraced portion 6*b* of the associated second transverse profile 6, is intended to be engaged. Furthermore, each second transverse profile 6, in particular each second embracing portion 6*a*, comprises an opening 8 in which the associated first transverse profile 5, in particular the first embraced portion 5*b* of the associated first transverse profile 5, is intended to be engaged. Both buckles 7 and openings 8 are used in order to prevent the side wings 3 and 4 from disengaging from each other in a direction other than the slidably direction of the side wings, in particular to prevent the side wings from disengaging from each other in a direction perpendicular to the transverse profiles 5 and 6. Furthermore, the first embraced portions 5*b* and the second embraced portions 6*b*, as well as the first embracing portions 5*a* and the second embracing portions 6*a*, are at least partially I-shaped profiles. Once the side wings assembled and according to their mutual embracement, the first embracing portions 5*a* prevent vertical displacements of the second embraced portions 6*b*, as well as their horizontal displacement in the direction of the back side 14. Similarly, the second embracing portions 6*a* prevent vertical displacements of the first embraced portion 5*b*, as well as their horizontal displacement in the direction of the back side 14. Moreover, the buckles 7 prevent horizontal displacement of the second embraced portion 6*b* in the direction of the front side 13. Similarly, the openings 8 prevent horizontal displacement of the first embraced portion 5*b* in the direction of the front side 13. Therefore, the mutual embracement of the first and second transverse profiles 5 and 6 mainly allow slidable displacement of the side wings one to each other in the direction of the first and second lateral ends 11 and 12. Consequently, once each side wing connected to the wheelchair frame 2 with the help of the connectors 10, the side wings are interdependent and form a stiff assembly due to their mutual embracement. The lengths of the first transverse profiles 5 are respectively equal to the lengths of the associated second transverse profiles 6. In this particular case, the lengths of the first embracing portions 5*a*, respectively of the first embraced portions 5*b*, can respectively be equal to the lengths of the associated second embraced portions 6*b*, respectively of the associated second embracing portions 6*a*.

In order to shape the backrest to the back of the user, the first transverse profiles 5 and the second transverse profiles 6 are curved.

Figure 5C:
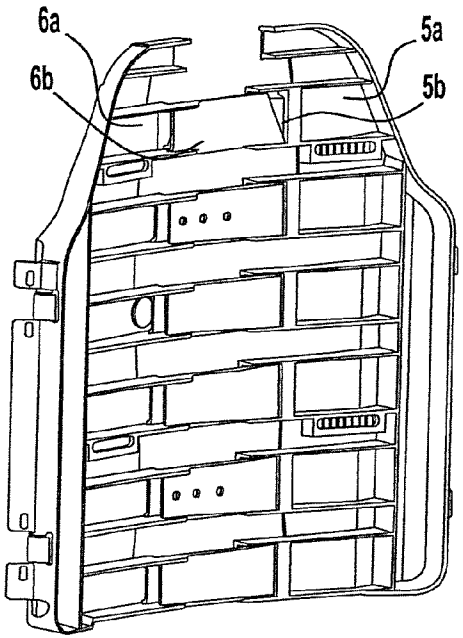
FIGS. 5*a*, 5*b*, and 5*c* depict three front perspective views of one pair of assembled side wings, respectively in thinnest, middle and widest positions, in accordance with FIG. 1.
Figure 5B:
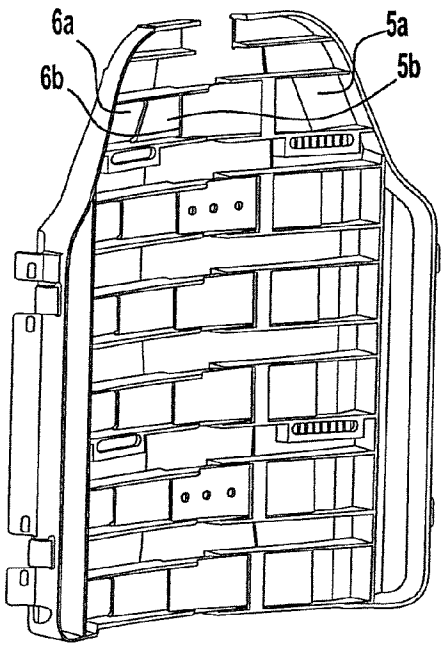
Figure 5A:
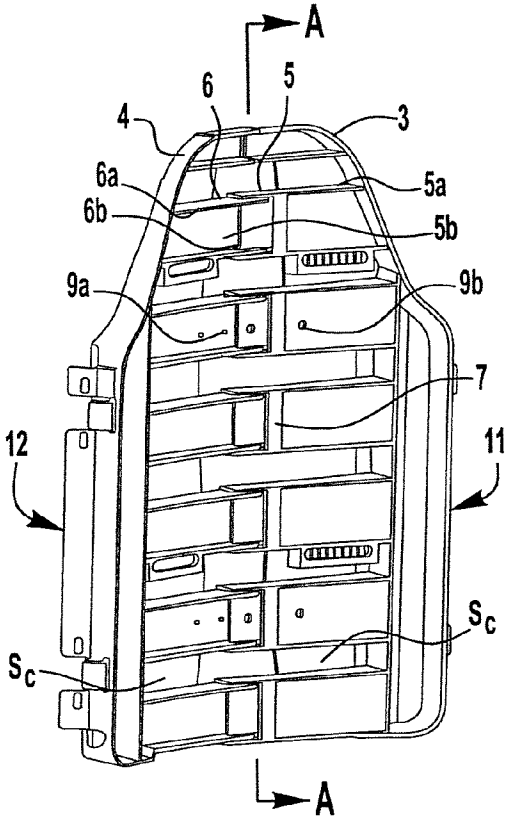
Figure 6C:
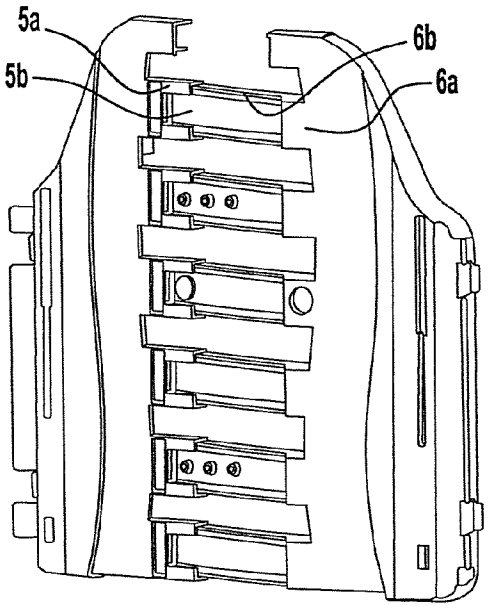
FIGS. 6*a*, 6*b*, 6*c* depict three back perspective views of one pair of assembled side wings, respectively in thinnest, middle and widest positions, in accordance with FIG. 1.
Figure 6B:
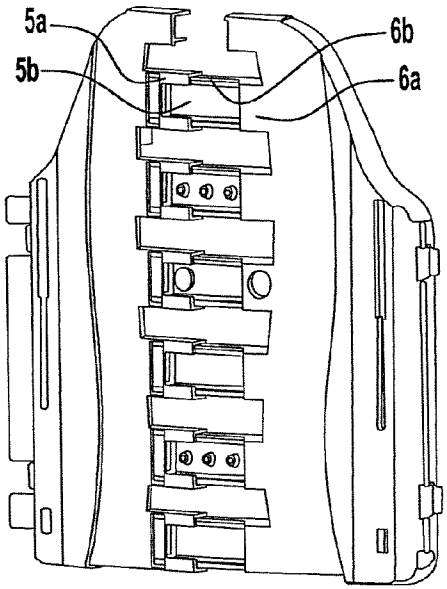
Figure 6A:
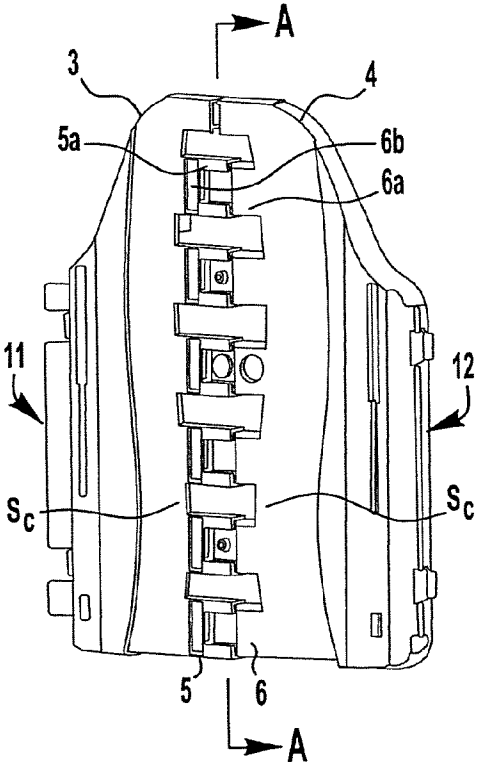

FIGS. 5*a*, 5*b*, and 5*c* depict three front perspective views of one pair of assembled side wings, respectively in thinnest, middle and widest positions, in accordance with FIG. 1. FIGS. 6*a*, 6*b*, 6*c* depict the same but in back perspective views. The mutual embracement of the first and second transverse profiles 5 and 6 are evidenced. In particular, the first embracing portions 5*a* and the second embracing portions 6*a* slidably at least partially embrace respectively the second embraced portions 6*b* and the first embraced portion 5*b*. Moreover, in the configuration in which the second embraced portions 6*b* are in contact with the first embraced portions 5*b*, the second embraced portions 6*b* slidably at least partially embrace the first embraced portions 5*b*. This configuration can be appreciated in FIGS. 5*b* and 5*c* as well as in FIGS. 6*b* and 6*c*.

Figure 7:
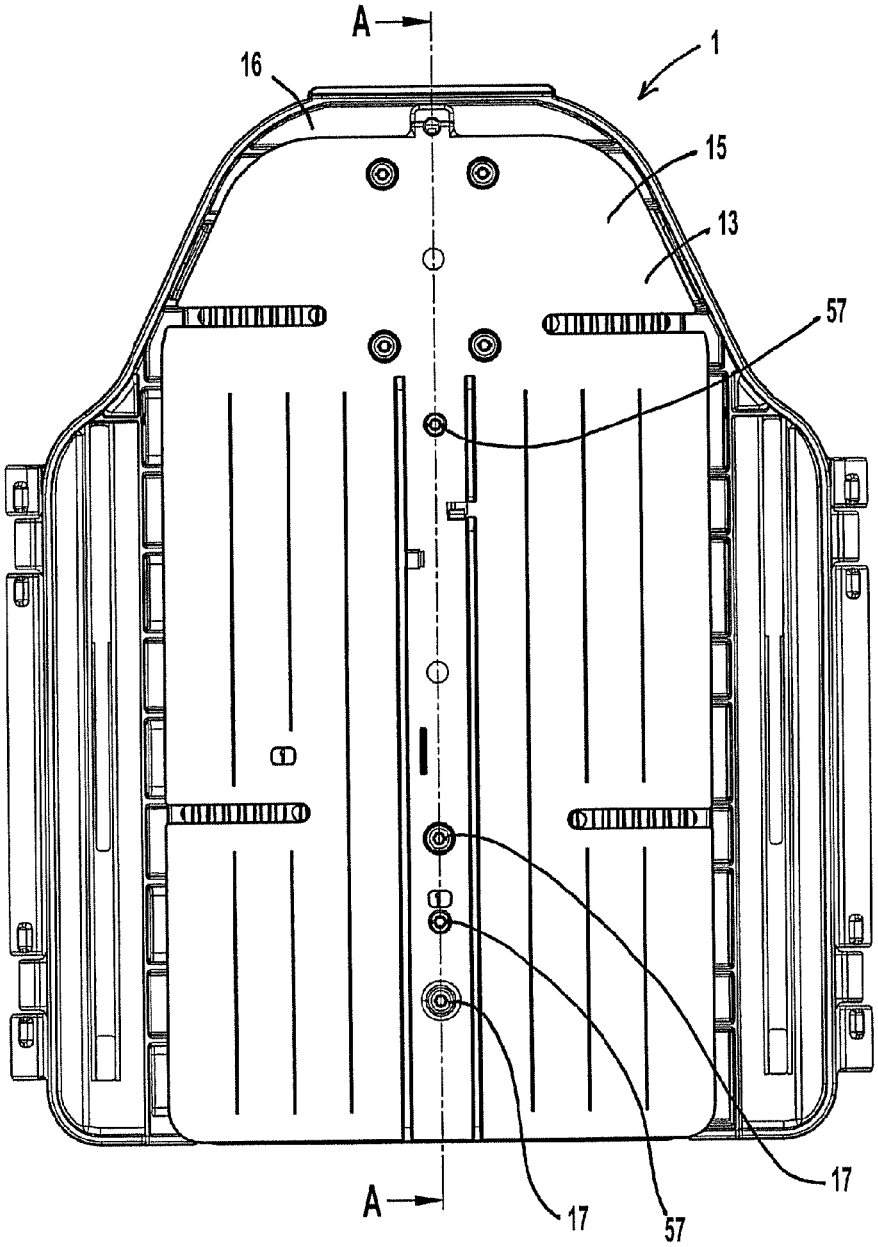
FIG. 7 depicts a back view of a backrest in accordance with FIG. 1.
Figure 7A:
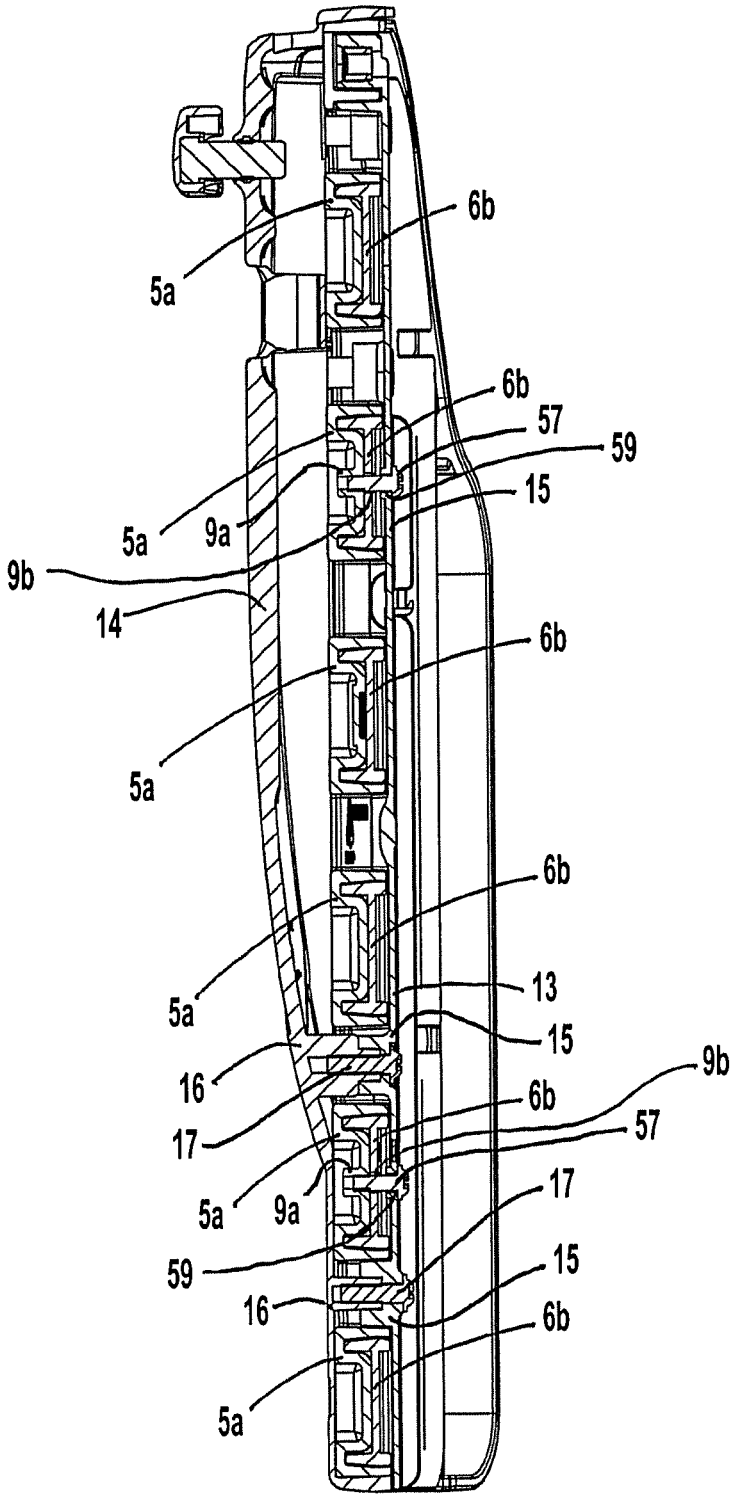
FIG. 7A is a sectional view taken along the plane indicated by lines A-A in FIG. 7.
Figure 7B:
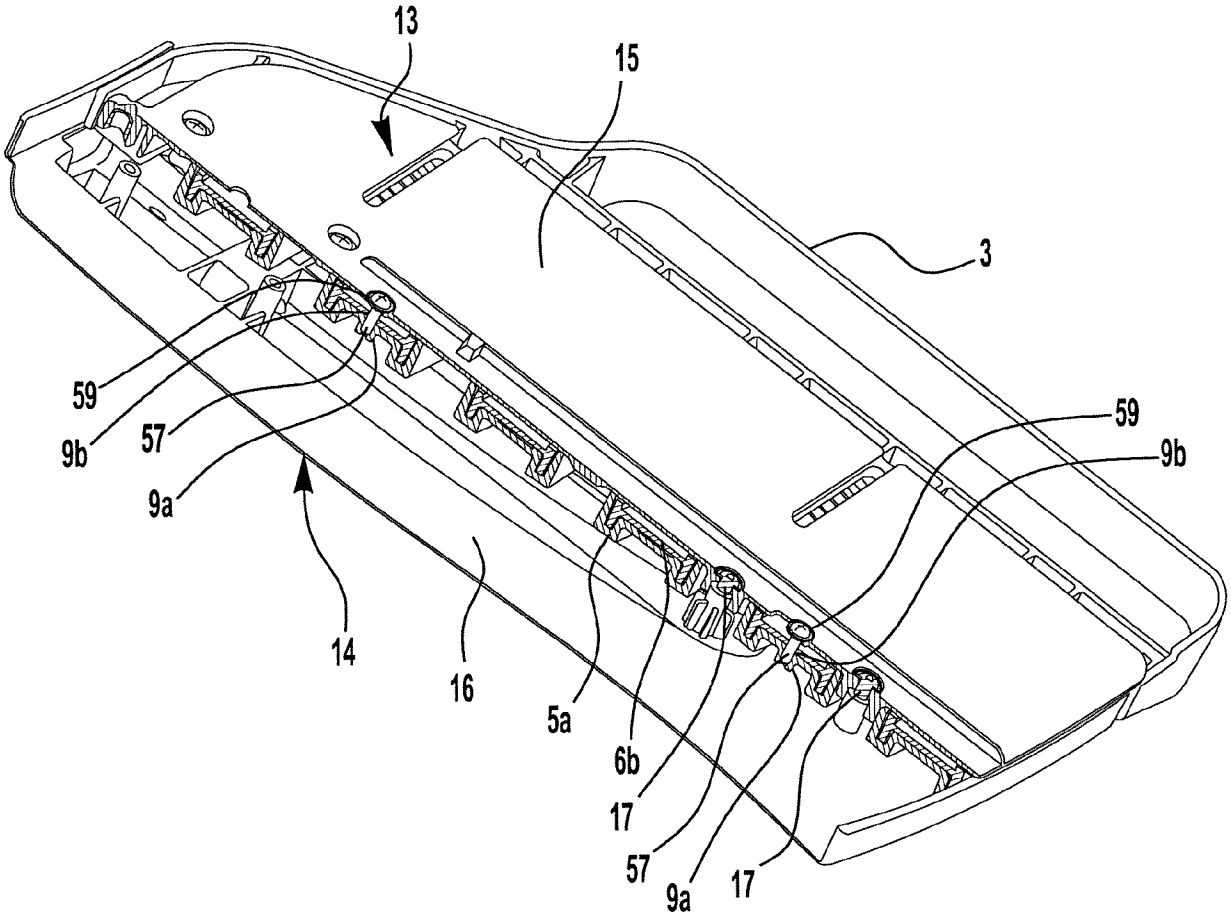
FIG. 7B is a sectional view taken along the plane indicated by lines A-A in FIG. 7.

FIG. 7 depicts a front view of an assembled backrest in accordance with FIG. 1. FIG. 7A is a sectional view taken along lines A-A in FIG. 7. FIG. 7B is a sectioned perspective view taken along lines A-A in FIG. 7. The respective position of the side wings corresponds to the one of FIGS. 5*a* and 6*a*, namely the assembled side wings in thinnest position. In FIG. 7B, the embracement between the first embracing portions 5*a* of the first side wing 3 and the second embraced portions 6*b* of the second wings 4 is evidenced. The I-shaped profile of the first embracing portions 5*a* and the I-shaped profile of the second embraced portions 6*b* are proportioned so that they fit tight together. Their respective cross-section does indeed not allow vertical displacement of the second embraced portions 6*b*. Moreover, the first embracing portions 5*a* embracing the second embraced portions 6*b*, the first embracing portions 5*a*, respectively the second embraced portions 6*b*, prevent horizontal displacement of the second side wing 4 in the direction of the back side 14, respectively horizontal displacement of the first side wing 3 in the direction of the front side 13.

The backrest of the invention being adjustable in width, it can be connected to a large variety of wheelchair frames. The width of the backrest can adjusted at the time of mounting according to the width of the frame. Advantageously, the backrest of the invention can be connected to a wheelchair frame which is extendable in width. Such type of width extendable wheelchair frame is known in the prior art.

The side wings and the plates are preferably made of plastic. They may each be manufactured as a single piece from injection molded plastic material, advantageously fiber reinforced plastic material. Other materials, without limitations, like metals such as stainless steal, aluminum, titanium, as well as fiberglass or wood may also be used to manufacture the parts.

Typical dimensions of the main parts of the backrest are hereafter provided. Each side wing, which is typically 48 cm in height, comprises typically six transverse profiles. The transverse profiles are typically about 27 cm in width and 4 cm in height. The embraced portions are typically about 15 cm in width. The vertical spacing between two adjacent transverse profiles is typically 40 cm. The first and second plates are typically 25 cm in width.

The above detailed description with reference to the drawings illustrates rather than limit the invention. There are numerous alternatives, which fall within the scope of the appended claims. For instance, other types of fasteners may also be used without departing from the invention. Moreover, variations of the above-mentioned invention embodiment are hereinafter specified (not shown on Figures).

In particular, the first transverse profiles, respectively the second transverse profiles, comprise each a plurality of first embracing portions and a plurality of first embraced portions, respectively a plurality of second embracing portions and a plurality of second embraced portions. On each first transverse profile, the plurality of first embracing portions is closer to the first lateral end of the backrest than the plurality of first embraced portions. Respectively, on each second transverse profile, the plurality of second embracing portions is closer to the second lateral end of the backrest than the plurality of the second embraced portions. At least one of the plurality of first embracing portions and at least one of the plurality of second embracing portions slidably at least partially embrace respectively at least one of the plurality of second embraced portions and at least one of the plurality of first embraced portions.

Furthermore, the backrest comprises a plurality of pair of side wings and optionally a plurality of pair of plates. The plurality of pair of side wings intended to be connected to the wheelchair frame can advantageously be connected to each other with the help of second fasteners. Each pair of plates is intended to sandwich each associated pair of side wings.

In addition, at least one first transverse profile comprises at least one first embracing portion having at least one hollow buckle in which at least one second embraced portion of the associated at least one second transverse profile is engaged. Similarly, at least one second transverse profile comprises at least one second embracing portion having at least one opening in which at least one first embraced portion of the associated at least one first transverse profile is engaged. Moreover, the positions of the at least one hollow buckle and the at least one opening can be inversed so that the at least one hollow buckle is positioned on the at least one second transverse profile and the at least one opening is positioned on the at the least one first transverse profile.

At least one first transverse profile comprises a plurality of first circular through holes and the associated at least one second transverse profile comprises a plurality of associated second circular through holes. The second fasteners may be passed through at least one of the plurality of first circular through holes and through at least one of the associated second circular though holes in order to fasten the side wings together. Moreover, the plurality of first circular through holes or the plurality of associated second circular through holes can be replaced by at least one elongated slot, the second fasteners passing through at least one of the plurality of first or associated second circular through holes and through at least one elongated slot in order to fasten the side wings together. Alternatively, the plurality of first circular through holes and the plurality of associated second circular through holes can be replaced each by at least one elongated slot. The combination of circular through holes and associated elongated slot or the combination of two elongated slots enables an infinite number of width configuration of the backrest whereas the number of width configuration is discrete with the combination of a discrete number of first circular through holes and associated second circular through holes.

Other profiles than I-shaped profiles can be used as long as the first embracing portions 5*a* and the second embracing portions 6*a* slidably at least partially embrace respectively the second embraced portions 6*b* and the first embraced portions 5*b*. For instance, U-shaped profiles can replace at least partially the I-shaped profiles, the first embracing portions 5*a* and the second embraced portions 6*b* being I-shaped profiles whereas the second embracing portions 6*a* and the first embraced portions 5*b* being for example U-shaped profiles or vice versa.

The slidably embracement of the side wings does not require the same orientation of the first transverse profiles, respectively the same orientation of the second transverse profiles. Indeed, the slidably embracement of the side wings does require that each first transverse profile of the first side wing has the same orientation as its associated second transverse profile of the second side wing.

Nomenclature

| Element | Reference sign |
|---|---|
| Backrest | 1 |
| First side wing | 3 |
| First transverse profile | 5 |
| First embracing portion | 5a |
| Buckle | 7 |
| First embraced portion | 5b |
| First circular through holes | 9a |
| Second side wing | 4 |
| Second transverse profile | 6 |
| Second embracing portion | 6a |
| Opening | 8 |
| Second embraced portion | 6b |
| Second circular through holes | 9b |
| First plate | 15 |
| Second plate | 16 |
| Wheelchair frame | 2 |

The invention claimed is:

1. A backrest intended to be connected to a wheelchair frame comprising a first lateral end, a second lateral end, a front side and a back side, at least one pair of side wings, namely a first side wing and a second side wing, that may be generally vertically oriented when connected to the wheelchair frame, and connectors configured to fixedly connect the first side wing and the second side wing to the wheelchair frame, wherein the first side wing comprises a plurality of vertically spaced first transverse profiles extending therefrom towards the second side wing and the second side wing comprises a plurality of vertically spaced second transverse profiles extending therefrom towards the first side wing, wherein at least one first transverse profile of the first side wing and at least one associated second transverse profile of the second side wing are at least partially mutually embraced in a slidable manner, the at least one first transverse profile and the at least one second transverse profile being dimensioned and configured so that the mutual slidably embracement of the at least one first transverse profile and the at least one second transverse profile is made on a range of distances enabling the width adjustment of the backrest, the mutual embracement of the at least one first transverse profile and the at least one second transverse profile being configured to prevent the side wings from disengaging from each other in a direction other than the slidably direction of the side wings and the first transverse profiles, respectively the second transverse profiles, being at least partially linked together so as to define approximately a continuous surface ($S_c$), and wherein at least one first transverse profile comprises at least one hollow buckle in which the associated at least one second transverse profile is engaged in order to prevent the side wings from disengaging from each other in a direction other than the slidabley direction of the side wings.

2. The backrest according to claim 1, wherein the first transverse profiles and the second transverse profiles are parallel with each other.

3. The backrest according to claim 1, wherein at least one second transverse profile comprises at least one opening in which the associated at least one first transverse profile is engaged in order to prevent the side wings from disengaging from each other in a direction other than the slidably direction of the side wings.

4. The backrest according to claim 1, wherein the connectors comprise at least one first clamp disposed at the first lateral end of the backrest and at least one second clamp disposed at the second lateral end of the backrest, the at least one first clamp and the at least one second clamp being adapted for engaging the wheelchair frame in order to connect respectively the first side wing and the second side wing to the wheelchair frame.

5. The backrest according to claim 1, wherein the first side wing and the second side wing are sandwiched between at least one pair of plates, namely a first plate and a second plate, connected with each other with the help of first fasteners, the first plate and the second plate being disposed on each side of the side wings, respectively on the front side and on the back side of the backrest.

6. The backrest according to claim 5, wherein the first plate comprises at least one through hole and the second plate comprises at least one associated threaded hole, and wherein the one or more first fasteners comprise at least one nut engaged in the at least one through hole and threaded onto the at least one associated threaded hole in order to fasten the first plate and the second plate together.

7. The backrest according to claim 6, wherein the at least one through hole and the at least one associated threaded hole are respectively positioned on the first plate and on the second plate so that the first fasteners means pass through a space between two adjacent transverse profiles of the same side wing and in that first fasteners means is positioned on a vertical symmetry axis of the backrest.

8. The backrest according to claim 5, wherein at least one first transverse profile comprises a plurality of first circular through holes and the associated at least one second transverse profile comprises a plurality of associated second circular through holes and in that at least one of the first plate or second plate comprises at least one third through hole and in that second fasteners may be passed through at least one of the plurality of first circular through holes, through at least one of the plurality of associated second circular though holes and through at least one of the at least one third through hole in order to firmly fasten the first side wing, the second side wing, the first plate and the second plate together in a position of use in which the width of the backrest cannot be changed.

9. The backrest according to the preceding claim 8, wherein the second fastening means comprise at least one nut engaged in the at least one of the plurality of first circular through holes, in the at least one of the plurality of associated second circular through holes and in at least one of the at least one third through hole and threaded onto a bolt.

10. The backrest according to claim 8, wherein the plurality of first circular through holes, the plurality of associated second circular through holes and the at least one third through hole are respectively positioned on the at least one first transverse profile, on the at least one second transverse profile and on one of the first plate or second plate so that the second fasteners can be positioned on a vertical symmetry axis of the backrest.

11. The backrest according to claim 1, wherein the first transverse profiles and the second transverse profiles are curved in order to shape the backrest to the back of the user.

12. The backrest according to claim 1, wherein the first transverse profiles of the first side wing comprise each at least one first embracing portion and at least one first embraced portion, the at least one first embracing portion being closer to the first lateral end of the backrest than the at least one first embraced portion, and the second transverse profiles of the second side wing comprise each at least one second embracing portion and at least one second embraced portion, the at least one second embracing portion being closer to the second lateral end of the backrest than the at least one second embraced portion, and wherein at least one of the at least one first embracing portions of the first side wing and at least one of the at least one second embracing portions of the second side wing slidably at least partially embrace respectively at least one of the at least one second embraced portions of the second side wing and at least one of the at least one first embraced portions of the first side wing, the at least one first embracing portions, the at least one second embracing portions, the at least one first embraced portions and the at least one second embraced portions being dimensioned and configured so that the mutual slidably embracement of the side wings is made on a range of distances enabling the width adjustment of the backrest, and the at least one first embracing portions of the first side wing, respectively the at least one second embracing portions of the second side wing, being linked together so as to define approximately the continuous surface ($S_c$).

13. The backrest according to the preceding claim 12, wherein at least one of the at least one second embraced portions are in contact with at least one of the at least one first embraced portions and in that at least one of the at least one second embraced portions slidably at least partially embrace at least one of the at least one first embraced portions.

14. The backrest according to claim 12, wherein the lengths of the first transverse profiles are respectively equal to the lengths of the associated second transverse profiles and in that the length of the at least one first embracing portions respectively of the at least one first embraced portions, are respectively equal to the length of the associated at least one second embraced portions, respectively of the associated at least one second embracing portions.

15. The backrest according to claim 12, wherein the at least one first embracing portions and the at least one second embraced portions are I-shaped profiles and in that the at least one first embraced portions and the at least one second embracing portions are at least partially I-shaped profiles.

16. A wheelchair having a backrest according to claim 1.

17. The wheelchair according to the preceding claim 16, wherein the wheelchair frame is extendable in width.

18. The backrest according to claim 1 wherein the first transverse profile of the first side wing and the associated second transverse profile of the second side wing are at least partially mutually embraced such that a first portion of the first transverse profile is configured to embrace a first portion of the second transverse profile and a second portion of the first transverse profile is configured to be embraced by a second portion of the second transverse profile.

* * * * *

UNITED STATES PATENT AND TRADEMARK OFFICE

CERTIFICATE OF CORRECTION

PATENT NO. : 8,991,933 B2
APPLICATION NO. : 13/598136
DATED : March 31, 2015
INVENTOR(S) : Ulf Johansson It is certified that error appears in the above-identified patent and that said Letters Patent is hereby corrected as shown below:

In the claims

In claim 1 (column 9, line 60): please delete "connectors" and replace with --connecting means--.

In claim 4 (column 10, lines 35-36): please delete "the connectors" and replace with --the connecting means--.

In claim 5 (column 10, line 46): please delete "first fasteners" and replace with --first fastening means--.

In claim 6 (column 10, line 53): please delete "the one ore more first fasteners" and replace with --the first fastening means--.

In claim 7 (column 10, line 60): please delete "the first fasteners means" and replace with --the first fastening means--.

In claim 7 (column 10, line 62): please delete "first fasteners means" and replace with --the first fastening means--.

In claim 8 (column 11, line 3): please delete "second fasteners" and replace with --second fastening means--.

In claim 9 (column 11, line 10): please delete "the preceding claim."

In claim 10 (column 11, lines 21-22): please delete "the second fasteners" and replace with --the second fastening means--.

In claim 15 (column 12, lines 28-29): please delete "the at least one first embracing portion" and replace with --the first embracing portion--.

Signed and Sealed this
First Day of March, 2016

Michelle K. Lee

Michelle K. Lee
*Director of the United States Patent and Trademark Office*